US010699627B2

(12) United States Patent
Um et al.

(10) Patent No.: US 10,699,627 B2
(45) Date of Patent: Jun. 30, 2020

(54) DRIVING METHOD OF DISPLAY PANEL, DISPLAY PANEL AND DISPLAY DEVICE

(71) Applicant: BOE Technology Group Co., Ltd., Beijing (CN)

(72) Inventors: Yoonsung Um, Beijing (CN); Mingfu Han, Beijing (CN); Lijun Yuan, Beijing (CN); Guangliang Shang, Beijing (CN); Xing Yao, Beijing (CN); Haoliang Zheng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/287,403

(22) Filed: Feb. 27, 2019

(65) Prior Publication Data

US 2019/0347976 A1 Nov. 14, 2019

(30) Foreign Application Priority Data

May 14, 2018 (CN) ..... 2018 1 0457711

(51) Int. Cl.
*G09G 3/20* (2006.01)

(52) U.S. Cl.
CPC ..... *G09G 3/2074* (2013.01); *G09G 3/2003* (2013.01); *G09G 2300/0452* (2013.01); *G09G 2310/0278* (2013.01); *G09G 2310/0297* (2013.01); *G09G 2310/08* (2013.01); *G09G 2340/16* (2013.01)

(58) Field of Classification Search
CPC .. G09G 3/2074; G09G 3/2003; G09G 3/3225; G09G 3/3275; G09G 2300/0452; G09G 2310/0278; G09G 2310/0297; G09G 2310/08; G09G 2340/016
See application file for complete search history.

(56) References Cited

U.S. PATENT DOCUMENTS

| | | | | |
|---|---|---|---|---|
| 8,736,531 | B2 * | 5/2014 | Gondo | G09G 3/3648 345/94 |
| 2011/0096062 | A1 * | 4/2011 | Gondo | G09G 3/3614 345/212 |
| 2012/0113340 | A1 * | 5/2012 | Yaguma | G09G 3/3614 349/33 |
| 2014/0160172 | A1 * | 6/2014 | Lee | G09G 3/2003 345/690 |
| 2019/0012978 | A1 * | 1/2019 | Wen | G09G 3/3688 |
| 2019/0251930 | A1 * | 8/2019 | Yang | G09G 3/20 |

* cited by examiner

*Primary Examiner* — Tom V Sheng
(74) *Attorney, Agent, or Firm* — Nath, Goldberg & Meyer; Joshua B. Goldberg

(57) ABSTRACT

A driving method of a display panel, a display panel and a display device are disclosed. The method includes: for a first row of sub-pixels and a second row, adjacent to the first row, of sub-pixels, during a display period of a first frame image, inputting data signals to the first row of sub-pixels in a first order, and inputting data signals to the second row of sub-pixels in a second order opposite to the first order; and during a display period of a second frame image adjacent to the first frame image, inputting data signals to the first row of sub-pixels in the second order and inputting data signals to the second row of sub-pixels in the first order.

20 Claims, 3 Drawing Sheets

DRIVING METHOD OF DISPLAY PANEL, DISPLAY PANEL AND DISPLAY DEVICE

CROSS-REFERENCE TO RELATED APPLICATION

This application claims the benefit of priority to Chinese Patent Application No. 201810457711.X filed on May 14, 2018, the contents of which are incorporated herein in their entirety by reference.

TECHNICAL FIELD

The present disclosure relates to the field of display technology, and particularly relates to a driving method of a display panel, a display panel and a display device.

BACKGROUND

As full screens are increasingly mature, high-resolution and ultra-narrow bezel COF (Chip On Flex, or Chip On Film) technology is a must. For a small-size screen, such as a screen of a cell phone, multiplexer (MUX) technology can be utilized to achieve a narrow bezel design.

SUMMARY

The present disclosure provides a driving method of a display panel, a display panel, and a display device.

According to an aspect of the present disclosure, the present disclosure provides a driving method of a display panel. The display panel includes: a plurality of gate lines, a plurality of data lines, and a multiplexer, the plurality of gate lines and the plurality of date lines intersect with each other to define a plurality of sub-pixels arranged in multiple rows and multiple columns; the multiplexer is connected to at least two adjacent data lines; wherein the driving method of the display panel includes: for a first row of sub-pixels and a second row of sub-pixels included in sub-pixels connected to the at least two adjacent data lines, the first row and the second row being adjacent to each other;

during a display period of a first frame image, inputting data signals to the first row of sub-pixels in a first order while inputting a scan signal to the first row of sub-pixels; and inputting data signals to the second row of sub-pixels in a second order while inputting a scan signal to the second row of sub-pixels, the first order being opposite to the second order;

during a display period of a second frame image adjacent to the first frame image, inputting data signals to the first row of sub-pixels in the second order while inputting a scan signal to the first row of sub-pixels; and inputting data signals to the second row of sub-pixels in the first order while inputting a scan signal to the second row of sub-pixels.

According to some embodiments, the at least two adjacent data lines include a first data line to which a data signal is first input, a third data line to which a data signal is last input, and a second data line other than the first data line and the third data line, during a time for supplying a scan signal to one gate line, a time for supplying a data signal to each of the first data line and the third data line is T1, and a time for supplying a data signal to the second data line is T2, and T2 is greater than T1.

According to some embodiments, T2 is 1.2 to 1.4 times as long as T1.

According to some embodiments, the driving method further includes sequentially supplying scan signals to the plurality of gate lines along an arrangement direction of the plurality of gate lines.

According to some embodiments, each of the plurality of gate lines includes a first end and a second end, the first ends of all of the plurality of gate lines are located on a same side of the display panel, and the second ends of all of the plurality of gate lines are located on a same side of the display panel; wherein of any two adjacent gate lines, a scan signal is input from the first end of one gate line, and a scan signal is input from the second end of the other gate line.

According to some embodiments, each of the plurality of gate lines includes a first end and a second end, the first ends of all of the plurality of gate lines are located on a same side of the display panel, and the second ends of all of the plurality of gate lines are located on a same side of the display panel; and sequentially supplying scan signals to the plurality of gate lines along an arrangement direction of the plurality of gate lines includes: along the arrangement direction of the plurality of gate lines, supplying the scan signals to the plurality of gate lines line by line, wherein when supplying the scan signal to each of the plurality of gate lines, the scan signal is simultaneously supplied to the first end and the second end of the gate line.

According to some embodiments, sub-pixels connected to a same data line are of a same color; sub-pixels in a same row and connected to a same multiplexer are different in color.

According to some embodiments, the sub-pixels in a same row and connected to a same multiplexer include a red sub-pixel, a green sub-pixel, and a blue sub-pixel.

According to some embodiments, a number of the data lines connected to the multiplexer is equal to a number of sub-pixels in one pixel unit.

According to another aspect of the present disclosure, there is provided a display panel including: a plurality of gate lines, a plurality of data lines, and a multiplexer, the plurality of gate lines and the plurality of data lines intersecting with each other to define a plurality of sub-pixels arranged in multiple rows and multiple columns; the multiplexer being connected to at least two adjacent data lines; wherein the display panel further includes: a gate driver and a source driver; wherein sub-pixels connected to the at least two adjacent data lines include a first row of sub-pixels and a second row of sub-pixels, the first row and the second row being adjacent to each other;

during a display period of a first frame image, the source driver is configured to:

input data signals to the first row of sub-pixels in a first order while the gate driver inputs a scan signal to the first row of sub-pixels; and input data signals to the second row of sub-pixels in a second order while the gate driver inputs a scan signal to the second row of sub-pixels, the first order being opposite to the second order;

during a display period of a second frame image adjacent to the first frame image, the source driver is configured to:

input data signals to the first row of sub-pixels in the second order while the gate driver inputs a scan signal to the first row of sub-pixels; and input data signals to the second row of sub-pixels in the first order while the gate driver inputs a scan signal to the second row of sub-pixels.

According to some embodiments, the at least two adjacent data lines include a first data line to which a data signal is first input, a third data line to which a data signal is last input, and a second data line other than the first data line and the third data line, during a time for supplying by the gate driver a scan signal to one gate line, a time for supplying by the source driver a data signal to each of the first data line and the third data line is T1, and a time for supplying by the source driver a data signal to the second data line is T2, T2 being greater than T1.

According to some embodiments, T2 is 1.2 to 1.4 times as long as T1.

According to some embodiments, the gate driver is configured to sequentially supply scan signals to the plurality of gate lines along an arrangement direction of the plurality of gate lines.

According to some embodiments, each of the plurality of gate lines includes a first end and a second end, the first ends of all of the plurality of gate lines are located on a same side of the display panel, and the second ends of all of the plurality of gate lines are located on a same side of the display panel; and for any two adjacent gate lines, the gate driver is configured to supply the scan signal to the first end of one gate line, and supply the scan signal to the second end of the other gate line.

According to some embodiments, each of the plurality of gate lines includes a first end and a second end, the first ends of all of the plurality of gate lines are located on a same side of the display panel, and the second ends of all of the plurality of gate lines are located on a same side of the display panel; and the gate driver is configured to: supply, along the arrangement direction of the plurality of gate lines, the scan signals to the plurality of gate lines line by line, wherein when supplying the scan signal to each of the plurality of gate lines, the scan signal is simultaneously supplied to the first end and the second end of the gate line.

According to some embodiments, sub-pixels connected to a same data line are of a same color; and sub-pixels in a same row and connected to a same multiplexer are different in color.

According to some embodiments, the sub-pixels in a same row and connected to a same multiplexer include a red sub-pixel, a green sub-pixel, and a blue sub-pixel.

According to some embodiments, a number of the data lines connected to the multiplexer is equal to a number of sub-pixels in one pixel unit.

According to some embodiments, the multiplexer includes switching transistors whose number is the same as a number of the data lines connected to the multiplexer, and each of the switching transistors is connected in series between a corresponding data line and the source driver, wherein a control electrode of the switching transistor is connected to a timing controller of the display panel, a first electrode of the switching transistor is connected to the source driver, and a second electrode of the switching transistor is connected to the corresponding data line.

According to still another aspect of the present disclosure, there is provided a display device including a display panel according to the present disclosure.

DETAILED DESCRIPTION

To make those skilled in the art better understand the technical solutions of the present disclosure, the present disclosure will be further described in detail below in conjunction with the drawings and specific embodiments.

Multiplexer technology can allow data lines connected to sub-pixels in each pixel unit to share one data line. The multiplexer can provide a data signal to each of the data lines connected thereto, but this leads to an increase in power consumption.

In order to solve the problem of high power consumption due to the presence of the multiplexer, a method of providing data signals to the data lines is provided.

Figure 1:
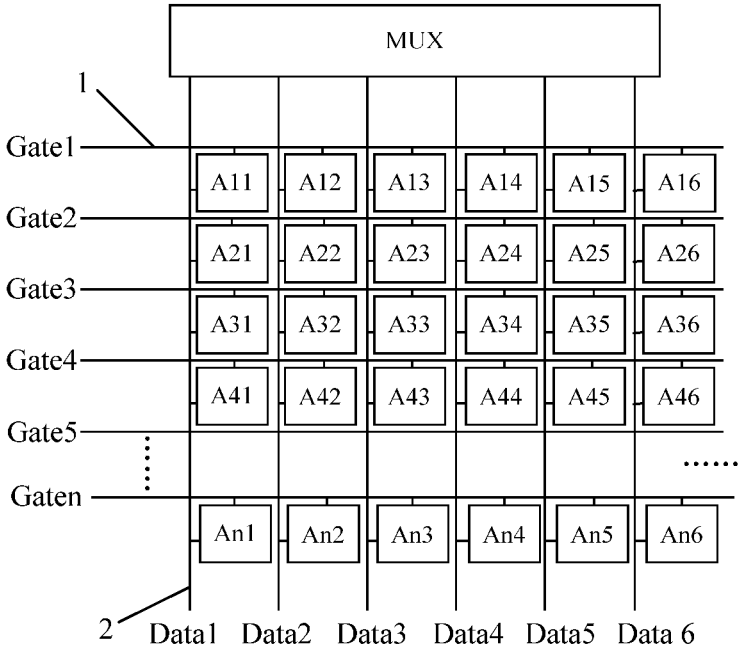
FIG. 1 is a schematic structural diagram of a display panel according to some embodiments of the present disclosure.

A display panel in FIG. 1 is taken as an example. A plurality of gate lines 1 and a plurality of data lines 2 on the display panel intersect with each other to define a plurality of sub-pixels Aij arranged in a plurality of rows and a plurality of columns, where i and j are integers. A multiplexer MUX is connected to a plurality of adjacent data lines 2, sub-pixels in a same column are connected to a same data line 2, and sub-pixels in different columns are connected to different data lines 2. In the array of the sub-pixels in the display panel shown in FIG. 1, it is assumed that the sub-pixels in the first column are red sub-pixels, the sub-pixels in the second column are green sub-pixels, and the sub-pixels in the third column are blue sub-pixels, and so on. A red sub-pixel, a green sub-pixel, and a blue sub-pixel located in a same row and adjacent to one another constitute one pixel unit.

The sub-pixels in the adjacent first, second, and third columns will be described as an example. When scanning the first row of sub-pixels, data signals are sequentially input, in the order of the data line Data1, the data line Data2, and the data line Data3, to the red sub-pixel A11, the green sub-pixel A12, and the blue sub-pixel A13 respectively connected to the data line Data1, the data line Data2, and the data line Data3; when scanning the second row of sub-pixels, data signals are sequentially input, in the order of the data line Data3, the data line Data2, and the data line Data1, to the blue sub-pixel A23, the green sub-pixel A22, and the red sub-pixel A21 respectively connected to the data line Data3, the data line Data2, and the data line Data1; when scanning the third row of sub-pixels, data signals are sequentially input, in the order of the data line Data1, the data line Data2, and the data line Data3, to the red sub-pixel A31, the green sub-pixel A32, and the blue sub-pixel A33 respectively connected to the data line Data1, the data line Data2, and the data line Data3; when scanning the fourth row of sub-pixels, data signals are sequentially input, in the order of the data line Data3, the data line Data2, and the data line Data1, to the blue sub-pixel A43, the green sub-pixel A42, and the red sub-pixel A41 respectively connected to the data line Data3, the data line Data2, and the data line Data1, and so on. In this way, data signals are written to the sub-pixels in an odd-numbered row in the order in which the data signals are input to the first row of sub-pixels, and data signals are written to the sub-pixels in an even-numbered row in the order in which the data signals are input to the second row of sub-pixels.

When writing the data signal to the blue sub-pixel A23 in the second row after writing the data signal to the blue sub-pixel A13 in the first row, the multiplexer MUX does not need to stop outputting the data signal to the data line Data3. At this time, the data line Data3 is not affected by the coupling capacitance, and no coupling voltage difference ΔVp is generated. However, when writing the data signal to the green sub-pixel A22 in the second row after writing the data signal to the blue sub-pixel A23 in the second row, the multiplexer MUX needs to stop outputting the data signal to the data line Data3. At this time, the data line Data3 is affected by the coupling capacitance, and a coupling voltage difference ΔVp is generated. As a result, the brightness of the blue sub-pixel A13 in the first row is higher than the brightness of the blue sub-pixel A23 in the second row. Similarly, when writing the data signal to the red sub-pixel A31 in the third row after writing the data signal to the red sub-pixel A21 in the second row, the multiplexer MUX does not need to stop outputting the data signal to the data line Data1. At this time, the data line Data1 is not affected by the coupling capacitance, and no coupling voltage difference ΔVp is generated. However, when writing the data signal to the green sub-pixel A32 in the third row after writing the data signal to the red sub-pixel A31 in the third row, the multiplexer MUX needs to stop outputting the data signal to the data line Data1. At this time, the data line Data1 is affected by the coupling capacitance, and a coupling voltage difference ΔVp is generated. As a result, the brightness of the red sub-pixel A21 in the second row is higher than the brightness of the red sub-pixel A31 in the third row. That is to say, among pixel units in a same column, blue sub-pixels in the odd-numbered rows are relatively bright, and red sub-pixels in the even-numbered rows are relatively bright, which causes a color shift in a display image.

Figure 2:
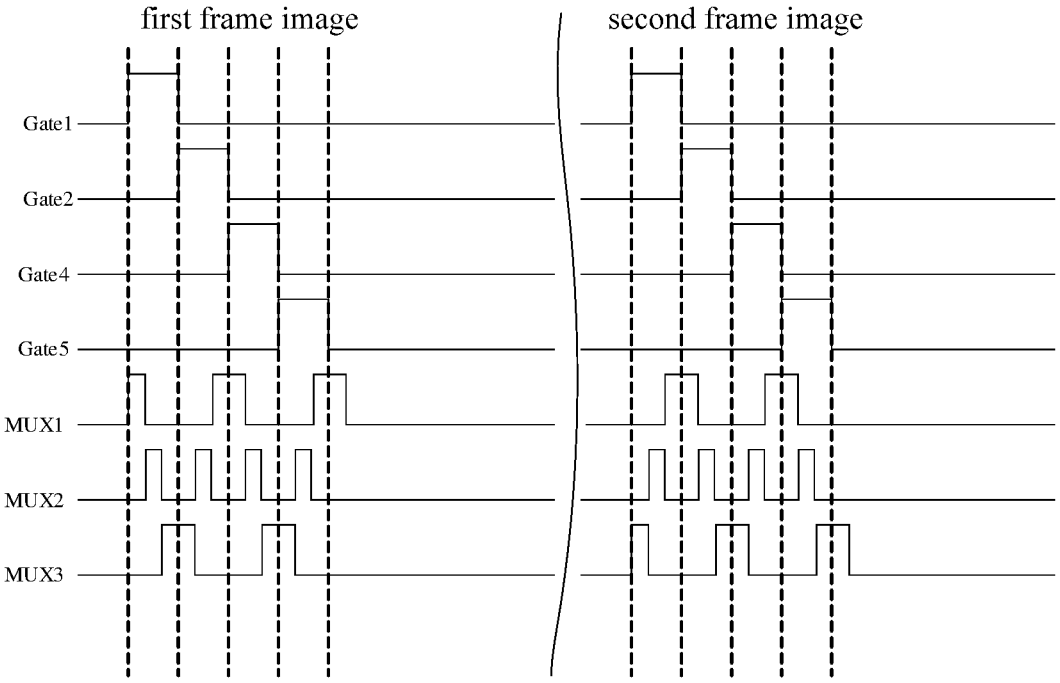
FIG. 2 is a timing diagram for driving the display panel of FIG. 1.
Figure 3:
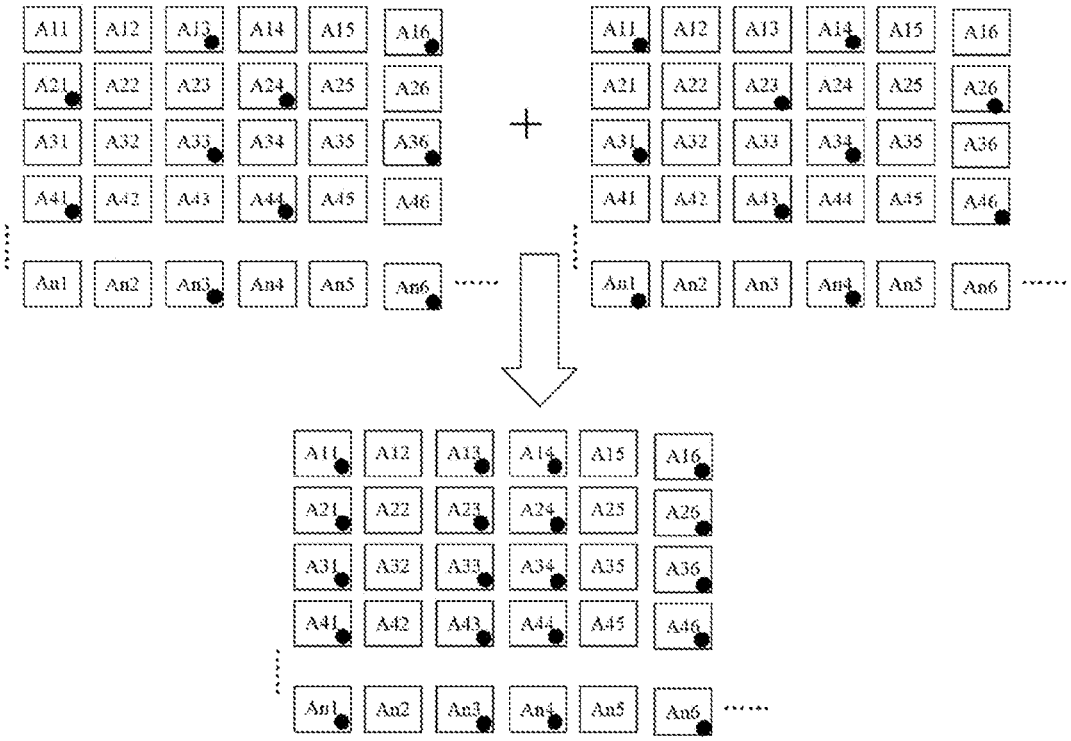
FIG. 3 is a diagram showing a display effect of a display panel according to some embodiments of the present disclosure.

According to a first aspect of the present disclosure, there is provided a driving method of a display panel. Referring to FIGS. 1 to 3, the display panel includes a plurality of gate lines 1, a plurality of data lines 2, and a multiplexer MUX. The plurality of gate lines 1 and the plurality of data lines 2 intersect with each other to define a plurality of sub-pixels arranged in a plurality of rows and a plurality of columns. The multiplexer MUX is connected to at least two adjacent data lines 2.

In some embodiments, the driving method of the display panel of the present disclosure includes: for adjacent first and second rows of sub-pixels among sub-pixels connected to the at least two adjacent data lines, during a display period of a first frame image, inputting data signals to the first row of sub-pixels in a first order while inputting a scan signal to the first row of sub-pixels; and inputting data signals to the second row of sub-pixels in a second order while inputting a scan signal to the second row of sub-pixels, the first order being opposite to the second order; and during a display period of a second frame image adjacent to the first frame image, inputting data signals to the first row of sub-pixels in the second order while inputting a scan signal to the first row of sub-pixels; and inputting data signals to the second row of sub-pixels in the first order while inputting a scan signal to the second row of sub-pixels.

In some embodiments, during the display period of the first frame image, when scanning any adjacent first and second rows of sub-pixels, data signals are input to the first row of sub-pixels in the first order while inputting a scan signal to the first row of sub-pixels; and data signals are input to the second row of sub-pixels in the second order while inputting a scan signal to the second row of sub-pixels. In an embodiment, the first order is an order from left to right in the row direction, and the second order is an order from right to left in the row direction. Alternatively, the first order is an order from right to left in the row direction, and the second order is an order from left to right in the row direction.

In one example, one multiplexer MUX is connected to three data lines 2, which are a first data line Data1, a second data line Data2, and a third data line Data3, respectively, and the three data lines are respectively connected to three sub-pixels, e.g., a red sub-pixel, a green sub-pixel, and a blue sub-pixel, in a same pixel unit. Two adjacent rows of sub-pixels are a first row of sub-pixels and a second row of sub-pixels, e.g., a row of sub-pixels scanned by a first gate line Gate1 and a row of sub-pixels scanned by a second gate line Gate2. In this case, sub-pixels defined by the first data line Data1, the second data line Data2, the third data line Data3, the first gate line Gate1 and the second gate line Gate2 are sub-pixels A11, A12 and A13 sequentially arranged in the first row and sub-pixels A21, A22, A23 sequentially arranged in the second row. The multiplexer supplies data signals to the first row of sub-pixels in the order of A11, A12, and A13, and supplies data signals to the second row of sub-pixels in the order of A23, A22, and A21. In a case where the two rows of sub-pixels to be subsequently scanned by the gate lines are a third row of sub-pixels and a fourth row of sub-pixels, sub-pixels defined by the first data line Data1, the second data line Data2, the third data line Data3, the third gate line Gate3 and the fourth gate line Gate4 are sub-pixels A31, A32 and A33 sequentially arranged in the third row and sub-pixels A41, A42, A43 sequentially arranged in the fourth row. An order in which data signals are written to the third row of sub-pixels is the same as the order in which the data signals are written to the first row of sub-pixels, and an order in which data signals are written to the fourth row of sub-pixels is the same as the order in which the data signals are written to the second row of sub-pixels. That is, the multiplexer MUX supplies the data signals to the third row of sub-pixels in the order of A31, A32, and A33 and supplies data signals to the fourth row of sub-pixels in the order of A43, A42, and A41.

In general, the data signals are sequentially written to the sub-pixels in the order of A11, A12, A13, A23, A22, A21, A31, A32, A33, A43, A42, and A41 by the multiplexer MUX. Since the sub-pixels A13 and A23 are both connected to the third data line Data3, the multiplexer MUX does not need to stop outputting the data signal to the third data line Data3 when writing the data signal to the sub-pixel A23. At this time, the third data line Data3 is not affected by the coupling capacitance, accordingly, no coupling voltage difference ΔVp is generated and the brightness of the sub-pixel A13 is not affected. However, after supplying the data signal to the sub-pixel A23, the multiplexer MUX stops outputting the data signal to the third data line Data3, and supplies the data signal to the sub-pixel A22 through the second data line Data2. At this time, the third data line Data3 is affected by the coupling capacitance to generate a coupling voltage difference ΔVp, which in turn affects the brightness of the sub-pixel A23. As a result, the brightness of the sub-pixel A13 is higher than the brightness of the sub-pixel A23. Similarly, the data signal is written to the sub-pixel A31 after the data signal is written to the sub-pixel A21. At this time, the brightness of the sub-pixel A21 is higher than the brightness of the sub-pixel A31 based on the above principle.

From the above, it can be seen that the brightnesses of the sub-pixels located in a same column are different during the display of one frame image.

The key of the above driving method of the display panel lies in that during a display period of a second frame image adjacent to the first frame image, data signals are input to the first row of sub-pixels in the second order while inputting a scan signal to the first row of sub-pixels; and data signals are input to the second row of sub-pixels in the first order while inputting a scan signal to the second row of sub-pixels.

As shown in FIG. 3, for example, in the first frame image (see the upper left part of FIG. 3), the multiplexer MUX supplies, through the data lines 2 connected thereto, data signals to the corresponding sub-pixels in the order of A11, A12, A13, A23, A22, A21, A31, A32, A33, A43, A42, A41, . . . , in this case, the brightness of the sub-pixel A13 is higher than the brightness of the sub-pixel A23, the brightness of the sub-pixel A21 is higher than the brightness of the sub-pixel A31, and the brightness of the sub-pixel A33 is higher than the brightness of the sub-pixel A43. That is, in the first frame image, the sub-pixels having higher brightness include A13, A21 and A33 (e.g., the sub-pixels marked with black dots in the first frame image in FIG. 3), and the sub-pixels having lower brightness include A23, A31 and A43.

In the second frame image (see the upper right part of FIG. 3), the multiplexer MUX supplies, through the data lines 2 connected thereto, data signals to the corresponding sub-pixels in the order of A13, A12, A11, A21, A22, A23, A33, A32, A31, A41, A42, A43, . . . , in this case, the brightness of the sub-pixel A11 is higher than the brightness of the sub-pixel A21, the brightness of the sub-pixel A23 is higher than the brightness of the sub-pixel A33, and the brightness of the sub-pixel A31 is higher than the brightness of the sub-pixel A41. In the second frame image, the sub-pixels having higher brightness include A11, A23 and A31 (e.g., the sub-pixels marked with black dots in the second frame image in FIG. 3), and the sub-pixels having lower brightness include A21, A33 and A41.

Since the display period of one frame is short, what can be viewed by human eyes is the superimposition of multiple frames. It can be seen from the display brightness in the first frame image and the second frame image in FIG. 3 that the sub-pixels having higher brightness in the first frame image have lower brightness in the second frame image, and the sub-pixels having lower brightness in the first frame image have higher brightness in the second frame image. The superimposed effect of the first frame image and the second frame image is as shown in the superimposed display image in FIG. 3 (see the lower part of FIG. 3). Therefore, after the two frame images are superimposed, the problem of non-uniform display of the display panel can be alleviated.

As can be seen from FIG. 3, in the display process of the above two frame images, for the data lines 2 connected to a same multiplexer MUX, the brightnesses of the sub-pixels connected to the data line 2 to which a data signal is last written by the multiplexer MUX in the first order and the brightnesses of the sub-pixels connected to the data line 2 to which the data signal is last written by the multiplexer MUX in the second order balance out. Compared with the two columns of sub-pixels connected to the data lines 2 to which the data signals are last written in the first order or in the second order, the sub-pixels in the other column, for example, the green sub-pixels in the second column, may have lower brightness. In some embodiments, a time for supplying the data signal to each data line 2 by the multiplexer MUX may be controlled to balance the overall brightness and improve the display effect of the display panel.

In some embodiments, the at least two adjacent data lines include a first data line to which a data signal is first written, a third data line to which a data signal is last written, and a second data line other than the first data line and the third data line. During a time for supplying a scan signal to one gate line, a time for supplying a data signal to each of the first data line and the third data line is T1, and a time for supplying a data signal to the second data line is T2, T2 being greater than T1.

In some embodiments, among the sub-pixels in a same row that are scanned by a same gate line, sub-pixels to which the data signals are last written in the second order through the corresponding data line 2 are sub-pixels to which the data signals are first written in the first order through the corresponding data line 2. For convenience of description, a case where three adjacent data lines are connected to a same multiplexer MUX is taken as an example, and the three data lines are connected to a red sub-pixel, a green sub-pixel, and a blue sub-pixel in a same pixel unit, respectively. One data line 2 to which a data signal is first written in the first order is defined as the first data line Data1, and one data line 2 to which a data signal is last written in the first order is defined as the third data line Data3, and the other data line is defined as the second data line Data2. The time for supplying a data signal to each of the first data line Data1 and the third data line Data3 by the multiplexer is T1, and the time for supplying a data signal to the second data line Data2 by the multiplexer is T2, T2 being greater than T1. As described above, the brightness of the sub-pixel connected to the first data line Data1 or the third data line Data3 is higher than the brightness of the sub-pixel connected to the second data line Data2, therefore, by setting T2 to be greater than T1, i.e., by increasing the time for supplying a data signal to each second data line Data2, the brightness of the sub-pixels connected to the second data line Data2 can be increased, thereby reducing the color shift and improving the display effect. In an example, T2 may be set to be 1.2 to 1.4 times as long as T1. Needless to say, the values of T2 and T1 may be determined depending on the color displayed by each sub-pixel and other information.

In some embodiments, the driving method further includes sequentially supplying scan signals to the plurality of gate lines along an arrangement direction of the plurality of gate lines. As shown in FIG. 1, the gate lines are scanned one by one along the arrangement direction on the display panel, e.g., from top to bottom (from Gate1 to Gate n) or from bottom to top (from Gate n to Gate1). This scanning sequence facilitates timing control. Moreover, the output of the shift register that supplies the scan signal to one gate line 1 can be directly used as the input to the shift register that supplies the scan signal to the next gate line 1, which facilitates wiring of the display panel and implementation of narrow bezel of the display panel. Needless to say, the gate lines may be scanned in any order, which is not limited herein.

In some embodiments, the gate lines 1 may be scanned by way of bilateral driving. For example, an even-odd driving method may be adopted. In the case of adopting the even-odd driving method, each gate line 1 includes a first end and a second end, the first ends of all the gate lines are located on a same side (e.g., the left side) of the display panel, and the second ends of all the gate lines are located at a same side (e.g., the right side) of the display panel. In some embodiments, as an implementation of bilateral driving, for any two adjacent gate lines 1, a scan signal is input from the first end of one of the two gate lines 1, and a scan signal is input from the second end of the other gate line 1. This implementation facilitates arrangement of shift registers. In some embodiments, as another implementation of bilateral driving, scan signals are simultaneously input to the first end and the second end of each gate line 1. This implementation can effectively alleviate the problem of affected image display due to insufficient charging time of the display panel caused by voltage drop (IR drop) on the gate line 1.

Figure 4:
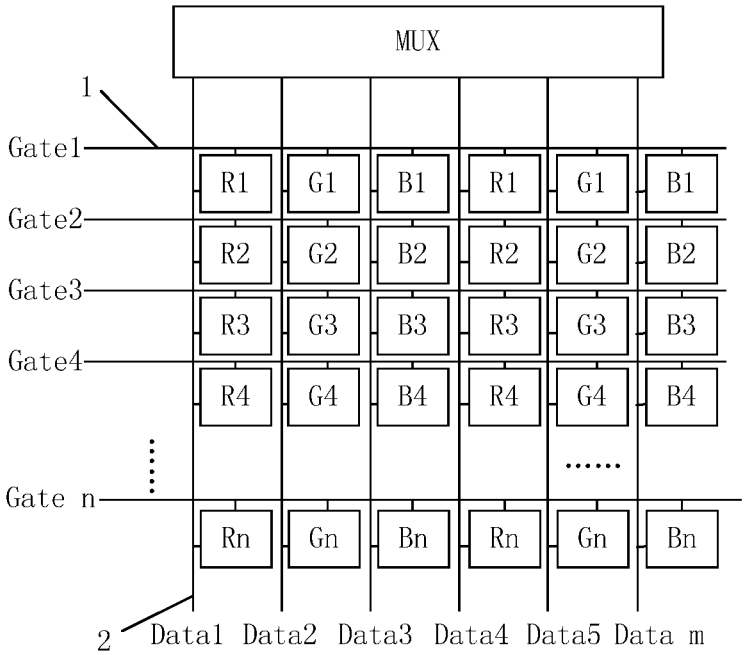
FIG. 4 is a schematic diagram of a specific structure of a display panel according to some embodiments of the present disclosure.
Figure 5:
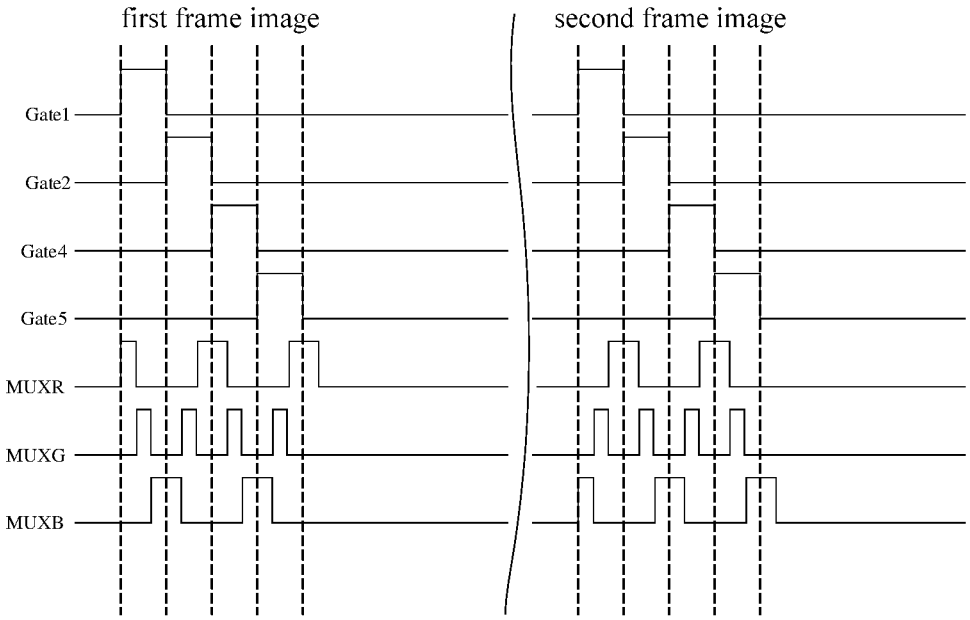
FIG. 5 is a timing diagram for display of the display panel of FIG. 4.

Referring to FIGS. 4 and 5, in some embodiments, in the display panel, the sub-pixels connected to a same data line 2 have a same color; the sub-pixels in a same row and electrically connected to a same multiplexer MUX have different colors. For example, the number of the data lines connected to the multiplexer is the same as the number of the sub-pixels in one pixel unit. In an embodiment, the sub-pixels located in a same row and electrically connected to a same multiplexer MUX include a red sub-pixel, a green sub-pixel, and a blue sub-pixel, which constitute one pixel unit, and each sub-pixel is connected to the multiplexer MUX through the corresponding data line. Hereinafter, description is given by taking a case where the gate lines 1 are scanned one by one in the arrangement order of the gate lines 1 on the display panel, and two frame images are displayed by three adjacent columns of sub-pixels as an example.

During display of the first frame image, the gate lines 1 are sequentially scanned line by line from the first gate line Gate1, and data signals are written to rows of sub-pixels by controlling the multiplexer MUX in the order of R1, G1, B1, B2, G2, R2, R3, G3, B3, B4, G4, R4, . . . , as shown in FIG. 4. Based on the above-described principle, the sub-pixels B1, R2, B3, R4 . . . (i.e., the blue sub-pixels in odd-numbered rows and the red sub-pixels in even-numbered rows) have higher brightness, and the sub-pixels R1, B2, R3, B4 . . . (i.e., the red sub-pixels in odd-numbered rows and the blue sub-pixels in even-numbered rows) have lower brightness.

During display of the second frame image, the gate lines 1 are sequentially scanned line by line from the first gate line Gate1, and data signals are written to rows of sub-pixels by controlling the multiplexer MUX in the order of B1, G1, R1, R2, G2, B2, B3, G3, R3, R4, G4, B4, . . . , as shown in FIG. 4. Based on the above-described principle, the sub-pixels R1, B2, R3, B4 . . . (i.e., the red sub-pixels in odd-numbered rows and the blue sub-pixels in even-numbered rows) have higher brightness, and the sub-pixels B1, R2, B3, R4 . . . (i.e., the blue sub-pixels in odd-numbered rows and the red sub-pixels in even-numbered rows) have lower brightness.

Needless to say, during the display of the second frame image, the timing of writing the data signals in the second frame image may be the same as that in the first frame image, but in this case, of the two adjacent gate lines, the even-numbered gate line needs to be scanned first, and then the odd-numbered gate line is scanned. In this way, the red sub-pixels located in the odd-numbered rows and the blue sub-pixels located in the even-numbered rows can have higher brightness, and the blue sub-pixels located in the odd-numbered rows and the red sub-pixels located in the even-numbered rows can have lower brightness.

Since the display period of one frame image is short, what can be viewed by human eyes is the superimposition of multiple frame images. It can be seen from the display brightness in the first frame image and the second frame image that the sub-pixels having higher brightness in the first frame image have lower brightness in the second frame image, and the sub-pixels having lower brightness in the first frame image have higher brightness in the second frame image. The two frame images are superimposed, so that the brightnesses of the sub-pixels (the red sub-pixels and the blue sub-pixels) having lower/higher brightness in the two frame images balance out, which can alleviate the color shift of the display panel. For the green sub-pixels having intermediate brightness, the brightness of the green sub-pixels may be adjusted by controlling the time for applying, by the multiplexer MUX, data signals to the green sub-pixels.

Figure 6:
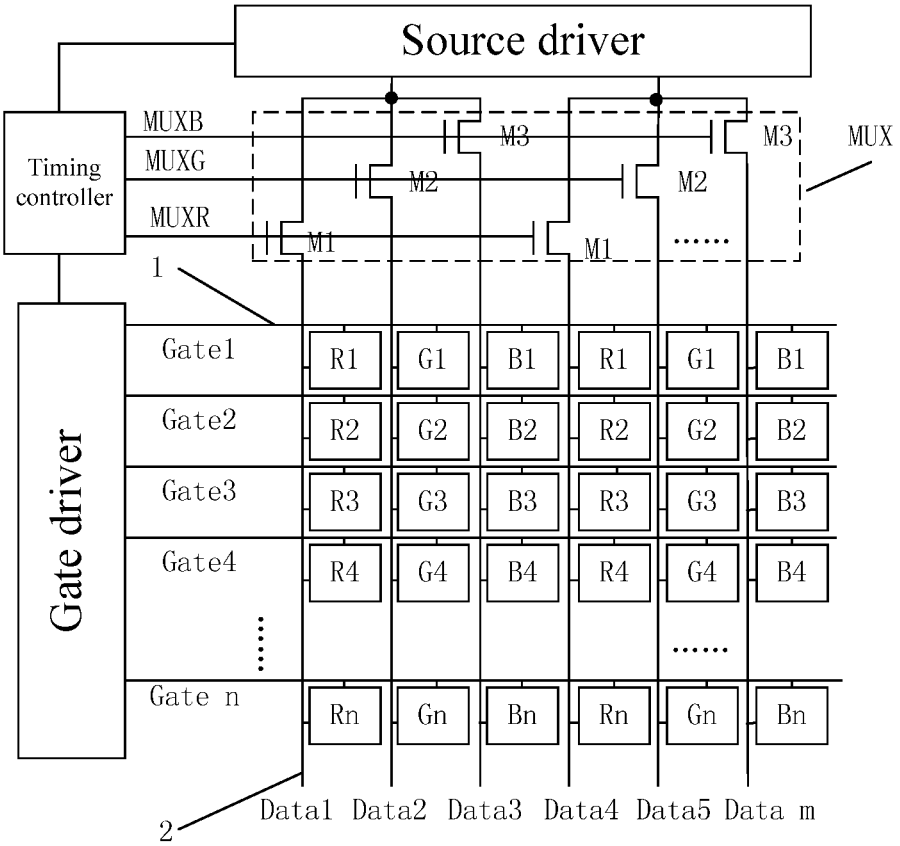
FIG. 6 is a schematic structural diagram of a display panel according to some embodiments of the present disclosure.

According to another aspect of the present disclosure, a display panel is provided. As shown in FIG. 6, the display panel includes a plurality of gate lines 1, a plurality of data lines 2, and a multiplexer MUX. The plurality of gate lines and the plurality of data lines intersect with each other to define a plurality of sub-pixels arranged in a plurality of rows and a plurality of columns; and the multiplexer is connected to at least two adjacent data lines. The display panel further includes: a gate driver and a source driver. For a first row of sub-pixels and a second row, which is adjacent to the first row, of sub-pixels among sub-pixels connected to the at least two adjacent data lines, during a display period of a first frame image, the source driver is configured to input data signals to the first row of sub-pixels in a first order while the gate driver inputs a scan signal to the first row of sub-pixels, and input data signals to the second row of sub-pixels in a second order while the gate driver inputs a scan signal to the second row of sub-pixels, the first order being opposite to the second order; and during a display period of a second frame image adjacent to the first frame image, the source driver is configured to input data signals to the first row of sub-pixels in the second order while the gate driver inputs a scan signal to the first row of sub-pixels, and input data signals to the second row of sub-pixels in the first order while the gate driver inputs a scan signal to the second row of sub-pixels.

In some embodiments, referring to FIG. 6, a case where the three adjacent data lines (the first data line Data1, the second data line Data2, and the third data line Data3) are connected to one multiplexer is taken as an example, each data line is connected to one column of sub-pixels, the three data lines are connected to three adjacent columns of sub-pixels, respectively, the three columns of sub-pixels are red sub-pixels, green sub-pixels, and blue sub-pixels, respectively, and three sub-pixels respectively connected to the three data lines and in a same row constitute one pixel unit, in this case, the number of the data lines connected to the multiplexer is the same as the number of the sub-pixels in one pixel unit.

In some embodiments, the at least two adjacent data lines include a first data line to which the data signal is first written, a third data line to which the data signal is last written, and a second data line other than the first data line and the third data line. The display panel further includes a timing controller configured to control operation timing of the gate driver and operation timing of the source driver. During a time for supplying, by the gate driver, a scan signal to one gate line, a time for supplying, by the source driver, a data signal to each of the first data line and the third data line is T1, and a time for supplying, by the source driver, a data signal to the second data line is T2, T2 being greater than T1. In some embodiments, T2 is 1.2 to 1.4 times as long as T1.

In some embodiments, the gate controller is further configured to sequentially supply scan signals to the plurality of gate lines along an arrangement direction of the plurality of gate lines.

In some embodiments, the gate line includes a first end and a second end, the first ends of all of the gate lines are on a same side of the display panel, and the second ends of all of the gate lines are on a same side of the display panel. For any two adjacent gate lines, the gate driver is configured to supply a scan signal to a first end of one of the two gate lines and supply a scan signal to a second end of the other gate line.

In some embodiments, the gate driver is configured to supply, along the arrangement direction of the plurality of gate lines, the scan signals to the plurality of gate lines line by line, and when supplying the scan signal to each of the plurality of gate lines, the scan signal is simultaneously supplied to the first end and the second end of the gate line.

In some embodiments, sub-pixels connected to a same data line are of a same color, and sub-pixels in a same row and electrically connected to a same multiplexer are of different colors.

In some embodiments, the sub-pixels in a same row and electrically connected to a same multiplexer include a red sub-pixel, a green sub-pixel, and a blue sub-pixel.

In some embodiments, one multiplexer MUX includes switching transistors, of which the number is the same as the number of data lines connected to the multiplexer MUX, and each of the switching transistors is connected in series between the corresponding data line and the source driver. The switching transistor has a control electrode connected to the timing controller, a first electrode connected to the source driver, and a second electrode connected to the corresponding data line. As shown in FIG. 6, one multiplexer MUX is connected to three data lines, and the multiplexer includes three switching transistors, namely, a first switching transistor M1, a second switching transistor M2, and a third switching transistor M3. A first electrode of the first switching transistor M1 is respectively connected in parallel with a first electrode of the second switching transistor M2 and a first electrode of the third switching transistor M3, and is connected to the source driver. A second electrode of the first switching transistor M1 is connected to the first data line Data1, and a control electrode of the first switching transistor M1 is connected to the timing controller. A second electrode of the second switching transistor M2 is connected to the second data line Data2, and a control electrode of the second switching transistor M2 is connected to the timing controller. A second electrode of the third switching transistor M3 is connected to the third data line Data3, and a control electrode of the third switching transistor M3 is connected to the timing controller. In this way, on and off states of each of the three switching transistors are controlled by the timing controller to control whether a data signal is written to a corresponding data line.

Description is given by taking a case of scanning the gate lines 1 one by one in the arrangement order of the gate lines on the display panel and displaying two frame images by the first three adjacent columns of sub-pixels as an example.

During display of the first frame image, the gate lines 1 are sequentially scanned line by line from the first gate line Gate1, the timing controller controls the first, second and third switching transistors M1, M2 and M3 in the multiplexer MUX to be turned on one by one, and thus data signals are written, by the source driver, to rows of sub-pixels in the order of R1, G1, B1, B2, G2, R2, R3, G3, B3, B4, G4, R4 . . . . Based on the above-described principle, the sub-pixels B1, R2, B3, R4 . . . (i.e., the blue sub-pixels in odd-numbered rows and the red sub-pixels in even-numbered rows) have higher brightness, and the sub-pixels R1, B2, R3, B4 . . . (i.e., the red sub-pixels in odd-numbered rows and the blue sub-pixels in even-numbered rows) have lower brightness.

During display of the second frame image, the gate lines 1 are sequentially scanned line by line from the first gate line Gate1, the timing controller controls the first, second and third switching transistors M1, M2 and M3 in the multiplexer MUX to be turned on one by one, and thus data signals are written, by the source driver, to rows of sub-pixels in the order of B1, G1, R1, R2, G2, B2, B3, G3, R3, R4, G4, B4 . . . . Based on the above-described principle, the sub-pixels R1, B2, R3, B4 . . . (i.e., the red sub-pixels in odd-numbered rows and the blue sub-pixels in even-numbered rows) have higher brightness, and the sub-pixels B1, R2, B3, R4 . . . (i.e., the blue sub-pixels in odd-numbered rows and the red sub-pixels in even-numbered rows) have lower brightness.

Needless to say, during the display of the second frame image, the timing of writing the data signals in the second frame image may be the same as that in the first frame image, but in this case, of the two adjacent gate lines, the even-numbered gate line needs to be scanned first, and then the odd-numbered gate line is scanned. In this way, the red sub-pixels located in the odd-numbered rows and the blue sub-pixels located in the even-numbered rows can have higher brightness, and the blue sub-pixels located in the odd-numbered rows and the red sub-pixels located in the even-numbered rows can have lower brightness.

Since the display period of one frame image is short, what can be viewed by human eyes is the superimposition of multiple frame images. It can be seen from the display brightness in the first frame image and the display brightness in the second frame image that the sub-pixels having higher brightness in the first frame image have lower brightness in the second frame image, and the sub-pixels having lower brightness in the first frame image have higher brightness in the second frame image. The two frame images are superimposed, and since the sub-pixels having higher brightness in the first frame image have lower brightness in the second frame image, the brightnesses of the red sub-pixels and the blue sub-pixels having lower/higher brightness in the first and second frame images balance out, which can alleviate the color shift of the display panel. For the green sub-pixels having intermediate brightness, the brightness of the green sub-pixels may be adjusted by controlling, by the timing controller, the time for applying data signals by the multiplexer MUX to the green sub-pixels.

According to a third aspect of the present disclosure, a display device including the above display panel is provided, and since the display device includes the above display panel, the display device can effectively alleviate the problem of color shift of the display panel.

The display device may be any product or component having a display function such as a liquid crystal panel, an electronic paper, a mobile phone, a tablet computer, a television, a display, a notebook computer, a digital photo frame, a navigator, or the like.

It could be understood that the above embodiments are merely exemplary embodiments adopted for describing the principle of the present disclosure, but the present disclosure is not limited thereto. Various variations and improvements may be made by those of ordinary skill in the art without departing from the spirit and essence of the present disclosure, and these variations and improvements shall also be regarded as falling into the protection scope of the present disclosure.

The invention claimed is:

1. A driving method of a display panel, the display panel comprising: a plurality of gate lines, a plurality of data lines, and a multiplexer, the plurality of gate lines and the plurality of date lines intersecting with each other to define a plurality of sub-pixels arranged in multiple rows and multiple columns; the multiplexer being connected to at least two adjacent data lines; wherein the driving method of the display panel comprises: for a first row of sub-pixels and a second row of sub-pixels comprised in sub-pixels connected to the at least two adjacent data lines, the first row and the second row being adjacent to each other, during a display period of a first frame image, inputting data signals to the first row of sub-pixels in a first order while inputting a scan signal to the first row of sub-pixels; and inputting data signals to the second row of sub-pixels in a second order while inputting a scan signal to the second row of sub-pixels, the first order being opposite to the second order, and during a display period of a second frame image adjacent to the first frame image, inputting data signals to the first row of sub-pixels in the second order while inputting a scan signal to the first row of sub-pixels; and inputting data signals to the second row of sub-pixels in the first order while inputting a scan signal to the second row of sub-pixels.

2. The driving method of claim 1, wherein the at least two adjacent data lines comprise a first data line to which a data signal is first input, a third data line to which a data signal is last input, and a second data line other than the first data line and the third data line, during a time for supplying a scan signal to one gate line, a time for supplying a data signal to each of the first data line and the third data line is T1, and a time for supplying a data signal to the second data line is T2, T2 being greater than T1.

3. The driving method of claim 2, wherein T2 is 1.2 to 1.4 times as long as T1.

4. The driving method of claim 1, further comprising: sequentially supplying scan signals to the plurality of gate lines along an arrangement direction of the plurality of gate lines.

5. The driving method of claim 4, wherein each of the plurality of gate lines comprises a first end and a second end, the first ends of all of the plurality of gate lines are located on a same side of the display panel, and the second ends of all of the plurality of gate lines are located on a same side of the display panel; and sequentially supplying scan signals to the plurality of gate lines along an arrangement direction of the plurality of gate lines comprises: along the arrangement direction of the plurality of gate lines, supplying the scan signals to the plurality of gate lines line by line, wherein when supplying the scan signal to each of the plurality of gate lines, the scan signal is simultaneously supplied to the first end and the second end of the gate line.

6. The driving method of claim 1, wherein each of the plurality of gate lines comprises a first end and a second end, the first ends of all of the plurality of gate lines are located on a same side of the display panel, and the second ends of all of the plurality of gate lines are located on a same side of the display panel; wherein of any two adjacent gate lines, a scan signal is input from the first end of one gate line, and a scan signal is input from the second end of the other gate line.

7. The driving method of claim 1, wherein sub-pixels connected to a same data line are of a same color; and sub-pixels in a same row and connected to a same multiplexer are of different colors.

8. The driving method of claim 7, wherein the sub-pixels in a same row and connected to a same multiplexer comprise a red sub-pixel, a green sub-pixel, and a blue sub-pixel.

9. The driving method of claim 8, wherein a number of data lines connected to the multiplexer is equal to a number of sub-pixels in one pixel unit.

10. A display panel comprising: a plurality of gate lines, a plurality of data lines, and a multiplexer, the plurality of gate lines and the plurality of data lines intersecting with each other to define a plurality of sub-pixels arranged in multiple rows and multiple columns; the multiplexer being connected to at least two adjacent data lines; wherein the display panel further comprises: a gate driver and a source driver;

sub-pixels connected to the at least two adjacent data lines comprise a first row of sub-pixels and a second row of sub-pixels, the first row and the second row being adjacent to each other, during a display period of a first frame image, the source driver is configured to:

input data signals to the first row of sub-pixels in a first order while the gate driver inputs a scan signal to the first row of sub-pixels; and input data signals to the second row of sub-pixels in a second order while the gate driver inputs a scan signal to the second row of sub-pixels, the first order being opposite to the second order;

during a display period of a second frame image adjacent to the first frame image, the source driver is configured to:

input data signals to the first row of sub-pixels in the second order while the gate driver inputs a scan signal to the first row of sub-pixels; and input data signals to the second row of sub-pixels in the first order while the gate driver inputs a scan signal to the second row of sub-pixels.

11. The display panel of claim 10, wherein the at least two adjacent data lines comprise a first data line to which a data signal is first input, a third data line to which a data signal is last input, and a second data line other than the first data line and the third data line, during a time for supplying by the gate driver a scan signal to one gate line, a time for supplying by the source driver a data signal to each of the first data line and the third data line is T1, and a time for supplying by the source driver a data signal to the second data line is T2, T2 being greater than T1.

12. The display panel of claim 11, wherein T2 is 1.2 to 1.4 times as long as T1.

13. The display panel of claim 12, wherein each of the plurality of gate lines comprises a first end and a second end, the first ends of all of the plurality of gate lines are located on a same side of the display panel, and the second ends of all of the plurality of gate lines are located on a same side of the display panel; and the gate driver is configured to: supply, along the arrangement direction of the plurality of gate lines, the scan signals to the plurality of gate lines line by line, wherein when supplying the scan signal to each of the plurality of gate lines, the scan signal is simultaneously supplied to the first end and the second end of the gate line.

14. The display panel of claim 11, wherein the gate driver is configured to sequentially supply scan signals to the plurality of gate lines along an arrangement direction of the plurality of gate lines.

15. The display panel of claim 11, wherein each of the plurality of gate lines comprises a first end and a second end, the first ends of all of the plurality of gate lines are located on a same side of the display panel, and the second ends of all of the plurality of gate lines are located on a same side of the display panel;

of any two adjacent gate lines, the gate driver is configured to supply a scan signal to the first end of one gate line, and supply a scan signal to the second end of the other gate line.

16. The display panel of claim 11, wherein the multiplexer comprises switching transistors whose number is the same as a number of data lines connected to the multiplexer, and each of the switching transistors is connected in series between a corresponding data line and the source driver, a control electrode of the switching transistor is connected to a timing controller of the display panel, a first electrode of the switching transistor is connected to the source driver, and a second electrode of the switching transistor is connected to the corresponding data line.

17. The display panel of claim 10, wherein sub-pixels connected to a same data line are of a same color; and sub-pixels in a same row and connected to a same multiplexer are of different colors.

18. The display panel of claim 17, wherein the sub-pixels in a same row and connected to a same multiplexer comprise a red sub-pixel, a green sub-pixel, and a blue sub-pixel.

19. The display panel of claim 18, wherein a number of data lines connected to the multiplexer is equal to a number of sub-pixels in one pixel unit.

20. A display device, comprising the display panel of claim 10.

* * * * *